United States Patent [19]

Brenholdt

[11] Patent Number: 4,688,726

[45] Date of Patent: Aug. 25, 1987

[54] METHOD AND APPARATUS FOR CONTROLLING A PARTICLE REFINING PROCESS

[75] Inventor: Irving R. Brenholdt, Stratford, Conn.

[73] Assignee: Champion International Corporation, Stamford, Conn.

[21] Appl. No.: 835,635

[22] Filed: Mar. 3, 1986

[51] Int. Cl.[4] ..... B02C 25/00

[52] U.S. Cl. ..... 241/28; 241/30; 241/37

[58] Field of Search ..... 241/30, 21, 33–37, 241/28

[56] References Cited

U.S. PATENT DOCUMENTS 3,248,061 4/1966 Franz ..... 241/34 X
4,454,991 6/1984 Brenholdt ..... 241/37

FOREIGN PATENT DOCUMENTS 2923507 1/1980 Fed. Rep. of Germany ..... 241/37
2157975 11/1985 United Kingdom ..... 241/34

*Primary Examiner*—Mark Rosenbaum
*Attorney, Agent, or Firm*—Evelyn M. Sommer

[57] ABSTRACT

A particle refining process is controlled in response to detected electron transfer phenomena. Pulses of electromagnetic radiation emanating from a refiner during a refining process are detected. The detected radiation is produced by dissociation and recombination phenomena in the particles being refined. The detected pulses are processed to obtain data indicative of the performance of the refining process. In particular, the mean pulse duration and mean energy per unit time of the detected pulses are computed. A process control signal is produced in response to the data, and the operation of the refiner is controlled with the process control signal to optimize the refining process.

21 Claims, 16 Drawing Figures

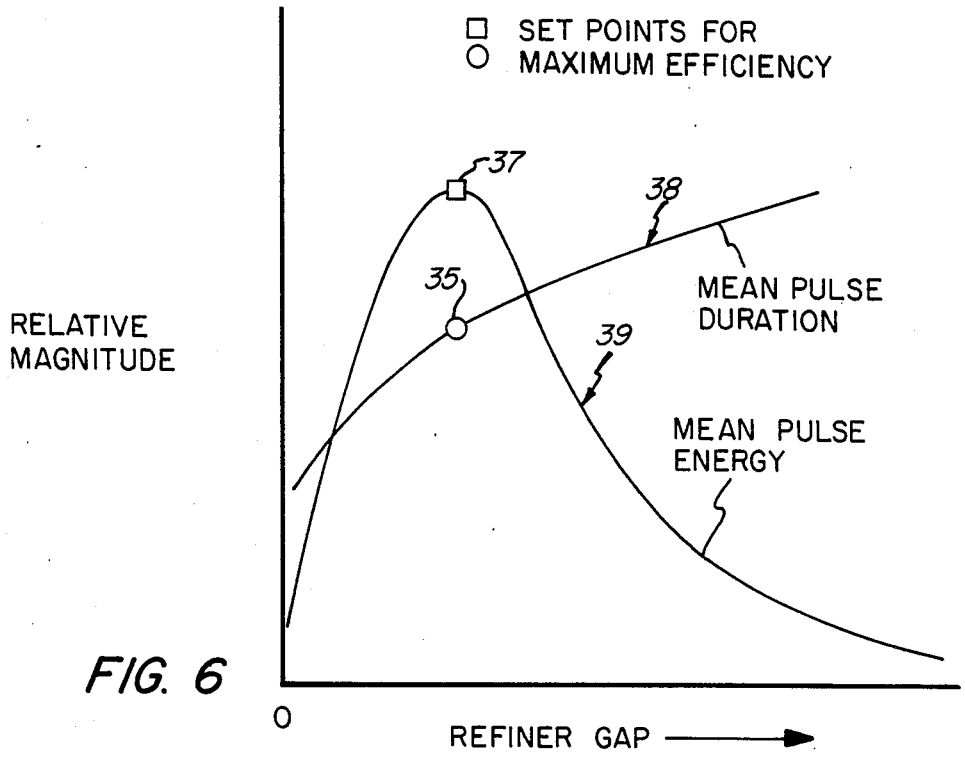
FIG. 6
FIG. 7
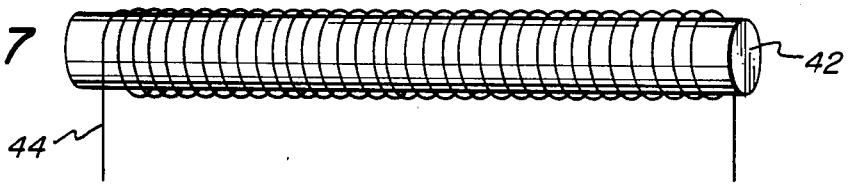
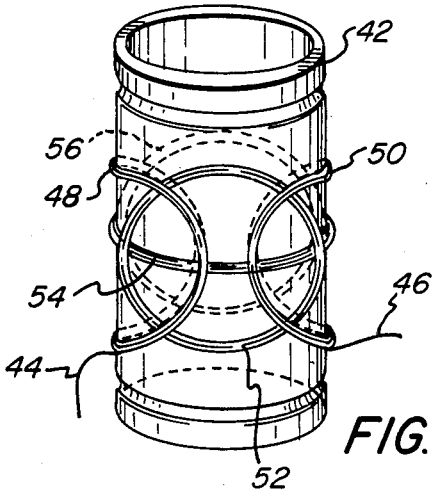
FIG. 8
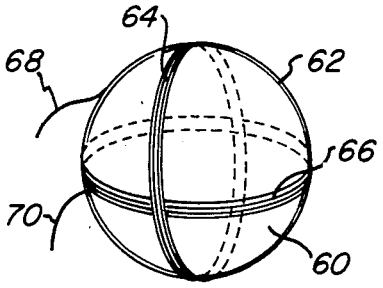
FIG. 9

METHOD AND APPARATUS FOR CONTROLLING A PARTICLE REFINING PROCESS

BACKGROUND OF THE INVENTION

The present invention relates generally to particle refining processes such as paper pulp manufacturing and more particularly to an apparatus and method for controlling a particle refining process in response to detected electron transfer phenomena.

In various refining processes, particles, including fibers and chips, must be subjected to mechanical treatment before they can be made into a finished product. For example, in manufacturing paper, cellulosic fibers must be ground or otherwise refined to make paper pulp which is then formed into paper webs or the like. This treatment may be applied in a number of different ways, but it generally includes a bruising, rubbing or crushing action on the fibers. The terms "beating" and "refining" are used in the paper industry to describe the operation of mechanically treating wood chips and pulp fibers. Refining usually refers to a fiber separation and subsequent fiber wall separation, i.e., primary, secondary and tertiary refining.

In one type of refining used in the paper industry and referred to as "disk refining", two parallel disks rotate relative to one another with a space therebetween. The surfaces of the disks have refiner plates mounted thereto which provide a refiner surface and define the refiner gap. The refiner plates have a precise configuration of angled bars and grooves so that wood chips or pulp fed into the gap will be subjected to a refining action. The distance between the refiner plates (i.e., the gap size) and the pressure exerted on the material being refined can be regulated to vary the degree of refining action. An example of such a disk refiner is provided in U.S. Pat. No. 4,454,991 issued June 19, 1984 and entitled "Apparatus and Method for Monitoring and Controlling a Disk Refiner Gap."

It is known that the degree of refining action in particle refining processes will influence the end product produced from the refined material. However, there has heretofore been no convenient way to predict the quality of the output from a particular refiner run without physically sampling the refined product and subjecting the sample material to physical and/or chemical tests.

It would be advantageous to provide an apparatus and method that would enable real-time ongoing monitor and control of a particle refining process without the need to test actual samples of the material being refined. It would be further advantageous to provide such an apparatus and method without the need to make any physical contact with the material being refined. Such "non-invasive" monitoring and control of the refining process would enable the benefits provided thereby to be realized without the need to modify existing refining machines.

The present invention relates to such an apparatus and method.

SUMMARY OF THE INVENTION

In accordance with the present invention, an apparatus and method are provided for controlling a particle refining process in response to detected electron transfer phenomena. Pulses of electromagnetic radiation emanating from a refiner during a refining process are received. The received pulses are processed to obtain data indicative of the performance of the refining process. A process control signal is then produced in response to the data, and the operation of the refiner is controlled using the process control signal to optimize the refining process.

The pulses of electromagnetic radiation can comprise polarized radiation emanating from the frame of a refiner due to electron/particle dissociation in a slurry being refined. In addition, the pulses can comprise randomly polarized radiation emanating from the slurry downstream from the refiner due to electron/particle recombination. A first signal indicative of pulse energy per unit time and a second signal indicative of pulse mean duration can be produced from the polarized radiation pulses due to dissociation. Similarly, a third signal indicative of pulse energy per unit time and a fourth signal indicative of pulse mean duration can be produced from the pulses of randomly polarized radiation due to recombination. A process control signal for controlling the operation of the refiner would be derived from the first, second, third, and fourth signals or any combination thereof.

The polarized radiation emanating from the refiner frame can be detected by a bi-polar antenna mounted adjacent the frame. Typically, such radiation is radiated in a plane normal to the frame. The randomly polarized radiation can be detected using a symmetrical multipolar antenna mounted adjacent the slurry being refined. Such antenna would have a uniform response to electromagnetic radiation polarized in any plane.

The process control signal can be produced by monitoring the first and third signals over a period of time to determine the maximum pulse energy per unit time in the polarized and randomly polarized radiation. The magnitude of the second and fourth signals (i.e., mean pulse duration) would then be measured upon occurrence of the maximum pulse energy per unit time. Finally, the process control signal would be set to maintain the second and fourth signals at the measured magnitude, thereby maintaining the pulse energy per unit time at its maximum level.

The present invention has application to any type of particle refining process wherein electron/particle dissociation and electron/particle recombination energy is produced. An example of such a refining process is that carried out by a thermal mechanical pulping machine having a metallic frame supporting a pair of spaced refiner disks defining a refiner gap. One of this pair of discs may be fixed and the other mounted for rotation or both may be rotating discs. Such a pulping machine includes means for adjusting the size of the refiner gap in response to a control signal. Input conduit means are provided for feeding material to be refined into the gap, and output conduit means are provided for transporting refined material from the gap to subsequent processing apparatus.

BRIEF DESCRIPTION OF THE DRAWINGS

FIG. 6 is a graphic representation of mean pulse duration and mean pulse energy showing set points from which the process control signal can be derived to maintain maximum efficiency in a refiner;

FIG. 7 (shown enlarged for clarity) is a diagrammatic illustration of a bi-polar antenna that can be used to detect polarized radiation emanating from the frame of a refiner;

FIG. 8 is a diagrammatic illustration of a five-coil multi-polar antenna formed around a non-magnetic, non-conductive pipe for detecting randomly polarized radiation emanating from a slurry flowing through the pipe;

FIG. 9 is a diagrammatic illustration of a multipolar antenna having three coils which can be immersed in a slurry to detect randomly polarized radiation emanating therefrom;

DETAILED DESCRIPTION OF THE INVENTION

The present invention provides a method and apparatus for sensing surface phenomena to facilitate the measurement, evaluation, and control of a particle refining process. The present applicant discovered, while obtaining data to provide a solution to the problem of plate clashing in a double disk thermal mechanical pulping machine, that a relatively high level of radio frequency electromagnetic radiation emanated from the pulping machine. While observing the phenomena on a portable oscilloscope using a coiled wire as an antenna, it was learned that the radiation was random in time and frequency and the predominant power versus frequency band extended well beyond the standard radio broadcast band. This was confirmed by subsequent experiments with several different pulp refining machines which demonstrated that all produced the radiation and, more importantly, a notable correlation was found between the radiation and physical properties of the refined pulp produced by the machines.

Figure 1:
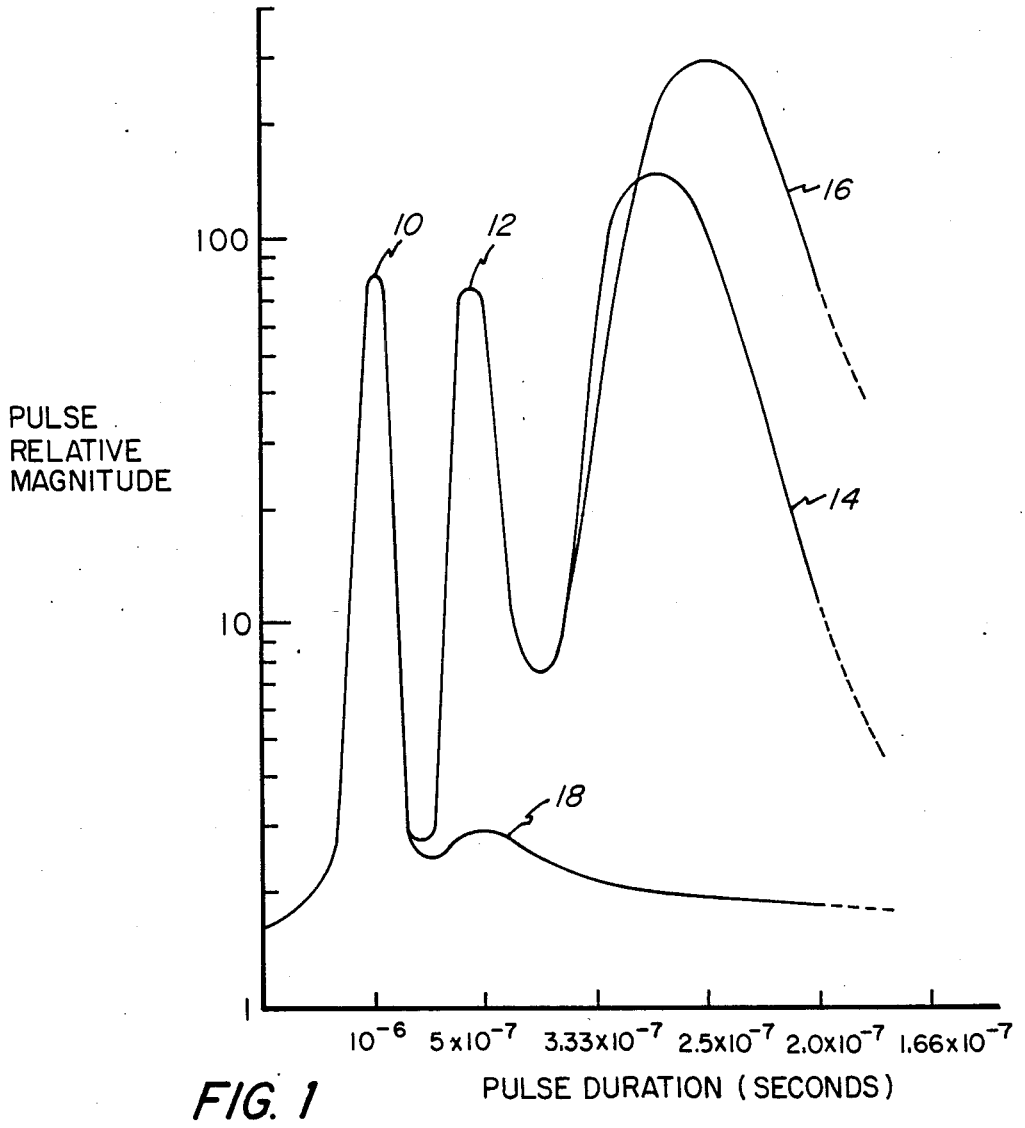
FIG. 1 is a graphic representation of electron transfer phenomena measured in double disk thermal mechanical pulping machines.

The graph shown in FIG. 1 illustrates electron transfer phenomena from the surface of particles (including bearing lubricant and pulp fibers) to the surfaces of a thermal mechanical pulp machine. The graph was produced by averaging electromagnetic pulses detected adjacent the pulping machine for 10 seconds. The y-axis of the graph of FIG. 1 is a logarithmic scale representing the relative magnitude of detected pulses. The x-axis represents pulse duration in seconds. Local radio stations, which occupy very narrow bands below $10^{-6}$ seconds, were identified with a direct entry communications receiver and data from those sources have been deleted from the graph of FIG. 1 since such data is out of the band of interest and of much lower magnitude.

The data plotted in FIG. 1 produced five distinct curves. Curve 10 represents radiation produced by the lubricated main bearings of the refiner. This radiation is constant in magnitude and pulse duration as long as the machine is running at synchronous speeds.

Curves 12 and 18 in FIG. 1 represent thrust bearing radiation, which is related to machine loading. Curve 12 represents the thrust bearing radiation which is produced when the machine is loaded. Under a no load condition, the thrust bearings produced the radiation represented by curve 18.

The important band of pulse duration, which relates to the actual refining process, extends from $5\times10^{-7}$ seconds to $1.5\times10^{-7}$ seconds. Radiation from the primary machine in the pulp refining process is represented by curve 14. This machine is inputted with wood chips, and the radiation is of longer duration and lower magnitude then that produced by a tertiary machine located downstream from the primary machine and which radiates in the much broader band represented by the curve 16.

Acquired data has also shown that the progress of wood chip refining to the desired pulp product can be identified by determining the mean duration of pulses at various stages of a refining process. The random "events" that produce the electromagnetic pulses radiated by each machine in the refining process resemble a Gaussian distribution which could be related to particle size. In addition to particle size differences, the broad band of pulse duration found to exist in data taken from the thermal mechanical pulping machine could also be the result of nearly coincident pulses producing events that would tend to increase the apparent pulse duration.

Figure 2:
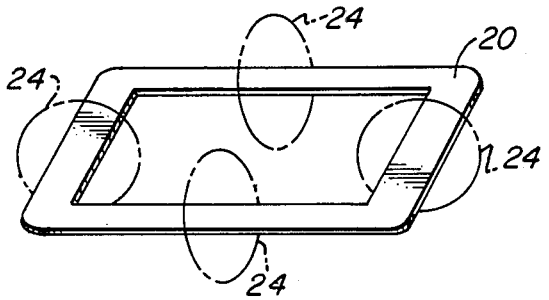
FIG. 2 is a diagramatic illustration of polarized radiation emanating from the frame of a refiner.

Two principal electron transfer phenomena occur during a particle refining process. The first occurs between particles (e.g., wood pulp fibers) and the refining surface. For purposes of the present description, this phenomena is referred to as "dissociation". Electric pulses flow in the metal support frame of the refining machine resulting in polarized radiation in a plane perpendicular to the frame. Such radiation is illustrated diagrammatically in FIG. 2, wherein polarized radiation generally designated 24 is emitted in a plane normal to the metal machine frame 20.

Figure 3:
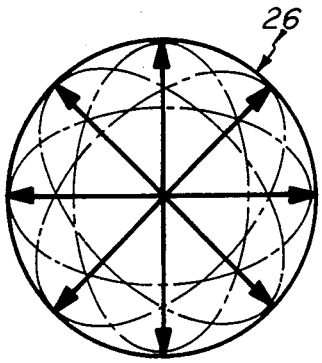
FIG. 3 is a diagramatic illustration of randomly polarized radiation emanating from a slurry being refined.

The second phenomena begins to occur within the material being refined (i.e., the "slurry") immediately after dissociation. Electric charges produce forces between particles and groups of other particles, thereby forming flocs. Discharges of the electric charges result in randomly polarized radiation, diagrammatically illustrated as radiation 26 in FIG. 3. For purposes of the present description, the phenomena which results in the randomly polarized radiation is referred to as "recombination". The recombination process is never totally completed, and a net charge is left in the slurry which is sometimes referred to as "Zeta potential."

Electron dissociation can be detected using a bi-polar antenna, such as that shown in FIG. 7 enlarged for ease of viewing. The antenna comprises a coil of wire 44

Figure 4:
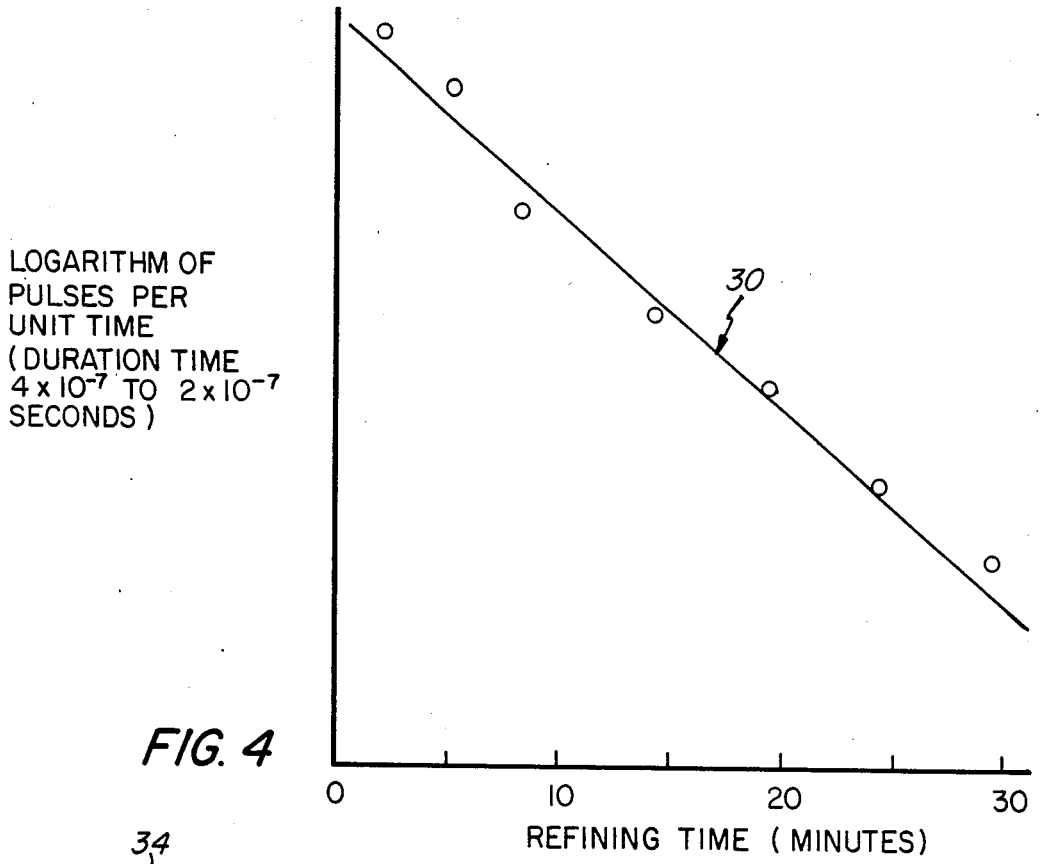
FIG. 4 is a graphic representation showing the rate of electron dissociation in a Valley beater using an external bi-polar antenna.

(e.g., 50 turns) wrapped around a low loss ferrite rod 42. Using such an antenna, located near the beating area of a Valley beater, the change in rate of electron dissociation was measured during 30 minutes of pulp beating. The results are plotted in FIG. 4 along the line 30 wherein the y-axis is a logarithmic scale representing pulses per unit time and the x-axis represents refining time in minutes. As shown, the number of pulses, and therefore the amount of polarized radiation, decreases as the refining time increases.

In order to detect randomly polarized radiation resulting from electron recombination, a symmetrical multipolar antenna having a uniform response to electromagnetic radiation polarized in any plane can be used. Examples of such antennas are shown in FIGS. 8 and 9. In FIG. 8, five coils 48, 50, 52, 54 and 56 are wrapped around a plastic pipe 42 in three mutually perpendicular planes. The coils are connected in additive series and can, for example, be 10 turns each for a total of 50 turns. The antenna is coupled to a circuit via leads 44 and 46 which are the beginning and end leads of the series connected coils. Pipe 42 is placed in series with the flow of a slurry being refined so that radiation emanating from the slurry can be detected.

The multi-polar antenna shown in FIG. 9 is of a construction that can be submerged in a slurry. Three coils 62, 64 and 66 are wrapped around a low loss granular ferrite core 60. Each coil can, for example, comprise 10 turns of wire for a total of 30 turns which are connected in additive series over three mutually perpendicular planes. The beginning and end leads 68, 70 of the series connected wire coils are used to couple the antenna to a receiver.

Figure 5A:
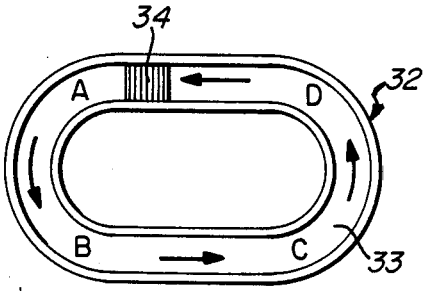
FIG. 5*a* is a diagrammatic illustration of the path taken by a slurry in a Valley beater.

Using a submerged multi-polar antenna such as that shown in FIG. 9, electron recombination was detected in a Valley beater represented diagrammatically in FIG. 5*a*. Valley beater 32 includes a trough 33 and a beating area 34 for the particle slurry. The slurry travels counter clockwise around the beating trough from point A to B to C to D. The recombination of charges is most vigorous at point A, where particles have just exited the beater at this point.

Figure 5B:
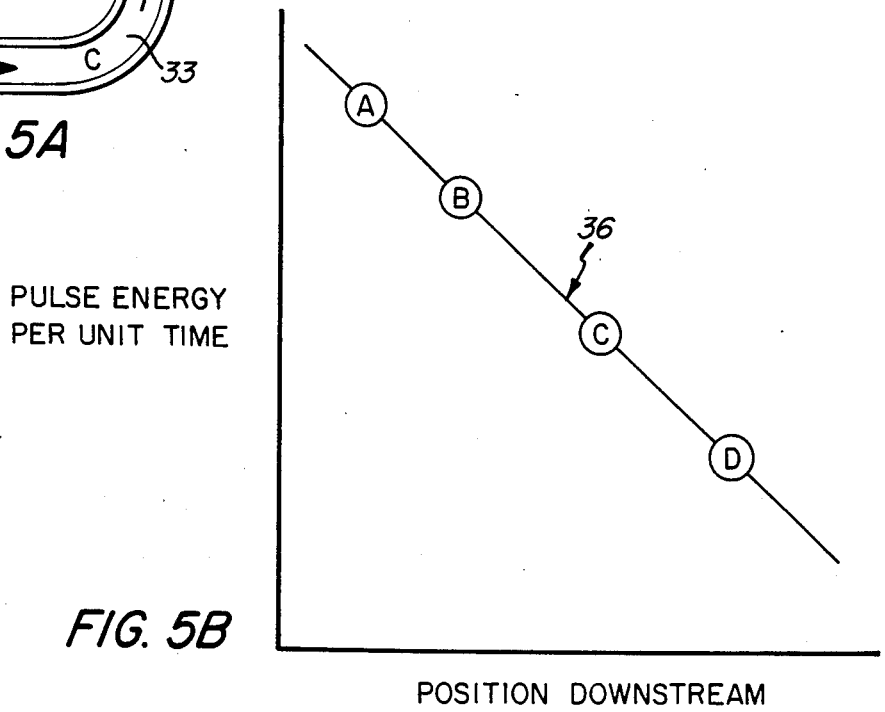
FIG. 5*b* is a graphic representation of pulse energy emitted due to electron recombination in the Valley beater of FIG. 5*a* as a function of the position downstream of the slurry.

The randomly polarized radiation detected at points A through D by the submerged multi-polar antenna is plotted on the graph of FIG. 5*b*. The y-axis represents pulse energy per unit time, and the x-axis represents the position downstream of the beating area. The resultant curve 36 shows that pulse energy decreases further away from the beating area.

The polarized radiation detected by the bi-polar antenna and randomly polarized radiation detected by the multi-polar antenna can be used to produce a process control signal for driving a particle refiner. A control principal for controlling a modern 20,000 horsepower, counter-rotating double disk refiner is shown in FIG. 6. A set point 35 for mean pulse duration (curve 38) relates to a refiner gap position that produces maximum pulse energy (set point 37, curve 39) in the frame of the machine. It is to be expected that maximum pulse energy will most likely be produced when the machine is running in its most efficient manner. Thus, in order to maintain the efficient operation of the machine, a process control signal can be produced and used as a feedback signal in a closed-loop control system in order to maintain the mean pulse duration of detected radiation at the pre-defined set point 37 corresponding with maximum mean pulse energy. One way of producing such a control signal is to initially monitor the pulse energy per unit time of the polarized radiation caused by dissociation and the randomly polarized radiation caused by recombination. During an initial time period (e.g. 5–10 minutes), the maximum pulse energy per unit time is determined. Then, the magnitude of the mean pulse duration that occurs during the maximum pulse energy is measured, and a process control signal is produced that will maintain the magnitude of the mean pulse duration at this level to maintain the pulse energy per unit time at a maximum. An illustrative flow chart of the several possible algorithms effective to produce such a control signal is shown in FIG. 15. The algorithm is described in detail below in connection with the block diagram of FIG. 14.

Figure 10:
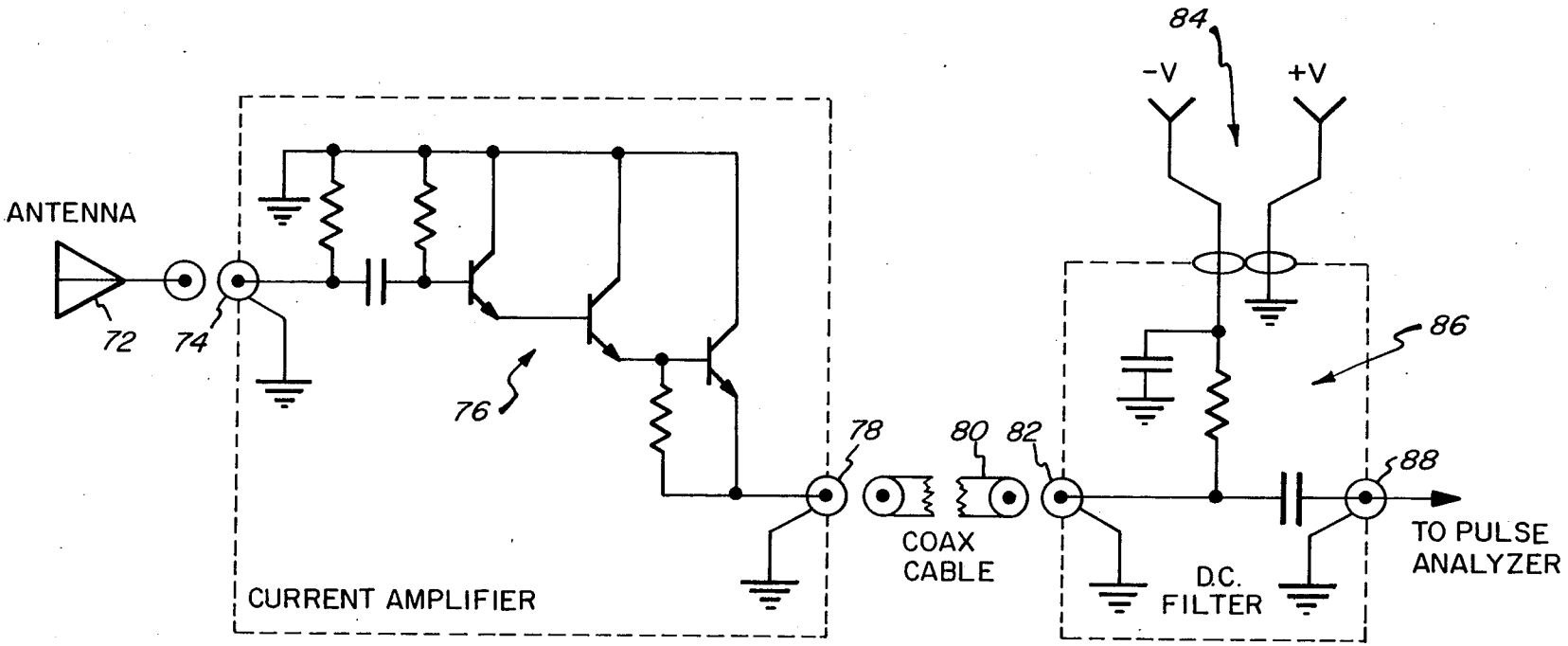
FIG. 10 is a schematic diagram of a current amplifier and DC filter for use in inputting signals detected by an antenna to an electronic pulse analyzer.

FIG. 10 illustrates a current amplifier which is used in conjunction with any of the bi-polar and multi-polar antennas of FIGS. 7, 8 and 9. The effective impedance of any of the antennas shown in the Figures is approximately 1,000 ohms. To achieve uniform response over a wide range of frequencies, and to enable antennas to be located remotely from the pulse detecting equipment, an electronic impedence transformer or current amplifier 76 is coupled to the antenna 72 via an input terminal 74. The current amplifier 76 will drive a 50 ohm line of the length required to reach the pulse analyzer circuitry which can be located, for example, in a process control room. The output of current amplifier 76 is coupled via output terminal 78 and a coaxial cable 80 to the input terminal 82 of a DC filter 86. Power for the current amplifier 76 is provided via input terminal 84 of the DC filter. The output of the current amplifier will appear at output terminal 88 of the DC filter and can be input therefrom to a pulse analyzer circuit such as that shown schematically in FIG. 11.

Figure 11:
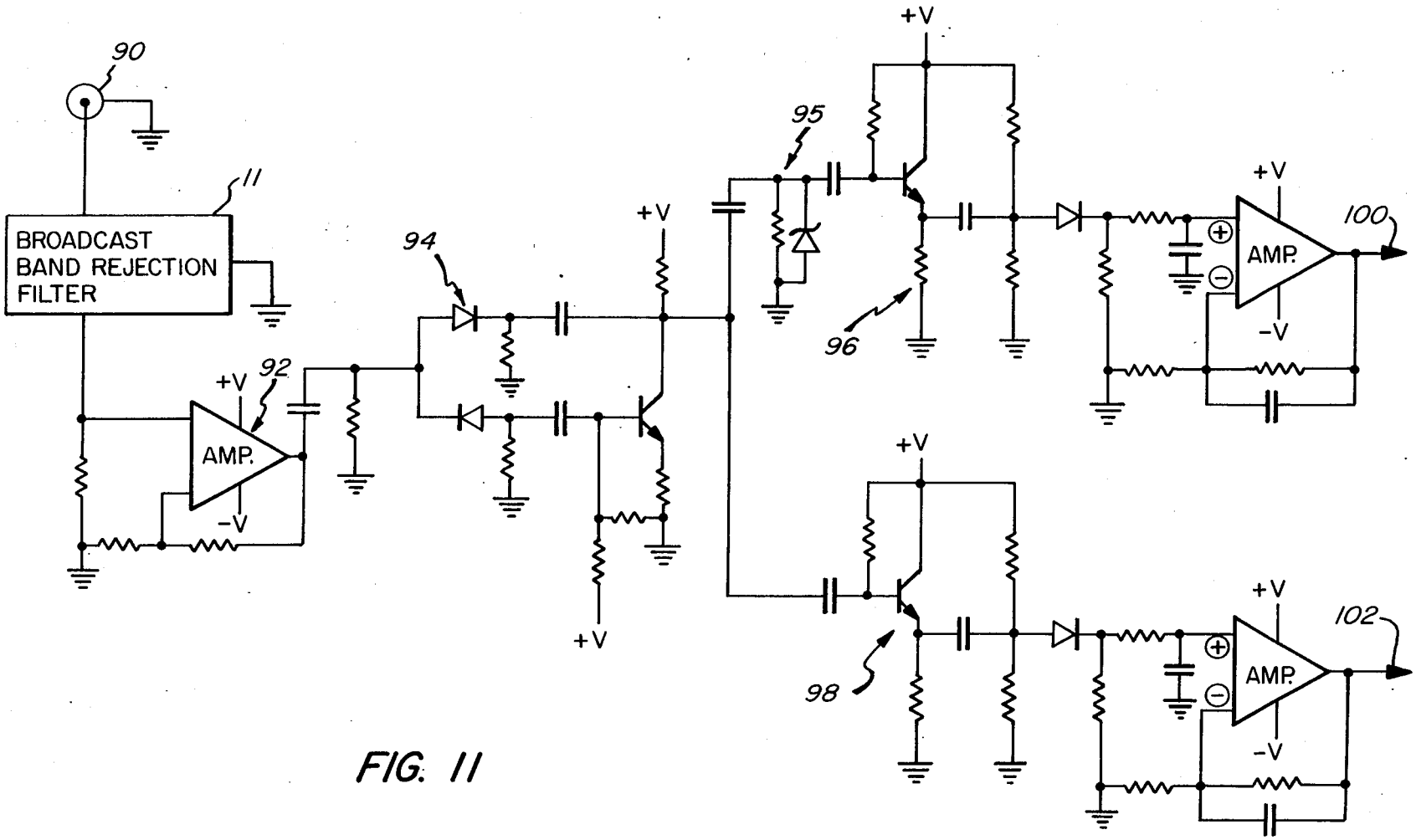
FIG. 11 is a schematic diagram of an electronic pulse analyzer.

The electronic pulse analyzer of FIG. 11 includes an input terminal 90 coupled to a broadcast band rejection filter 91. This filter is a high pass filter that rejects frequencies below 2 megahertz, including all of the standard AM broadcast bands as well as the signals generated by the bearings of mechanical pulping devices. An amplifier generally designated 92 amplifies the input signal and passes the amplified signal to a pulse polarity converter circuit 94. Circuit 94 converts positive and negative pulses to all positive pulses for subsequent processing in the electronic pulse analyzer.

The output of pulse polarity converter 94 is input to a pulse duration discriminator circuit 95, the output of which is inversely proportional to the duration of pulses input thereto. An analog circuit 96 takes the output of pulse duration discriminator 95 to produce a pulse duration output signal proportional to the RMS value of the inverse of the pulse duration. This output signal appears on output terminal 100 and ranges from 0 to 10 volts DC.

The output of pulse polarity converter 94 is also input directly to an analog circuit 98 (which is essentially indentical to circuit 96), the output of which is a signal proportional to the RMS value of pulse energy. This output signal appears on terminal 102, and ranges from 0 to 10 volts DC.

Figure 12:
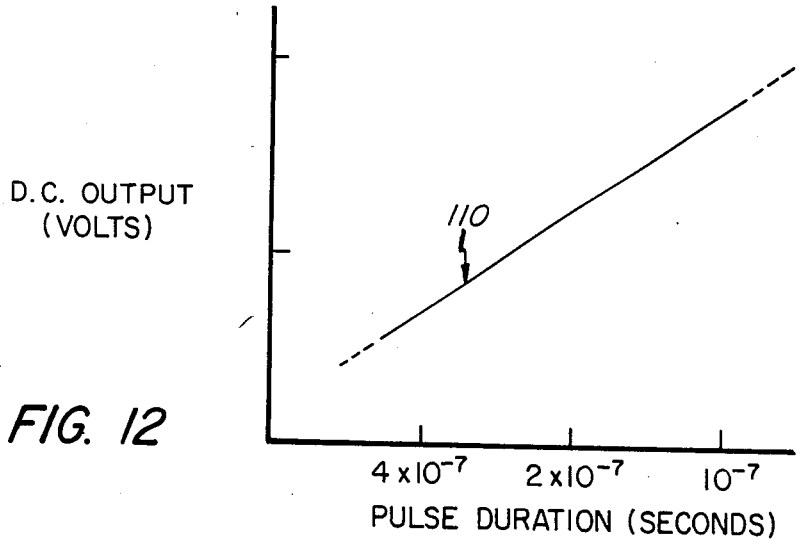
FIG. 12 is a graphic representation of the pulse duration signal output from the electronic pulse analyzer circuit of FIG. 11.

The transfer characteristic of the output signal from analog circuit 96 is plotted in FIG. 12. The y-axis represents the DC output voltage and the x-axis indicates the pulse duration in seconds. As indicated by curve 110, the DC output voltage of the circuits will increase as the pulse duration decreases.

Figure 13:
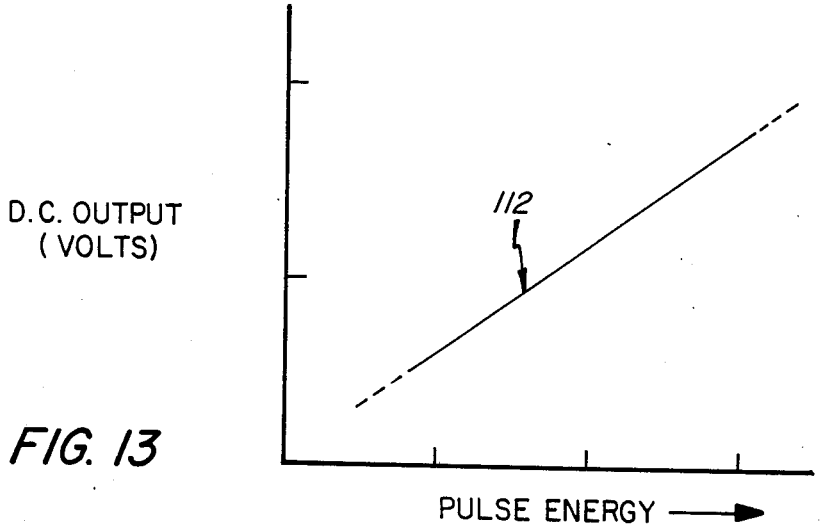
FIG. 13 is a graphic representation of the pulse energy signal output from the electronic pulse analyzer circuit of FIG. 11.

The transfer characteristic for the output signal from analog circuit 98 is plotted in FIG. 13. Again, the y-axis represents the DC output voltage. The x-axis indicates the pulse energy of pulses input to the electronic pulse analyzer circuit of FIG. 11. As indicated by curve 112, the output voltage of circuit 98 is proportional to the pulse energy, i.e., as the pulse energy goes up, the output voltage increases.

The output signals from the electronic pulse analyzer of FIG. 11 can be used to produce a process control signal for a refining machine. The output signals can also be used to drive displays that indicate the mean pulse duration and mean pulse energy of signals to the pulse analyzer.

Figure 14:
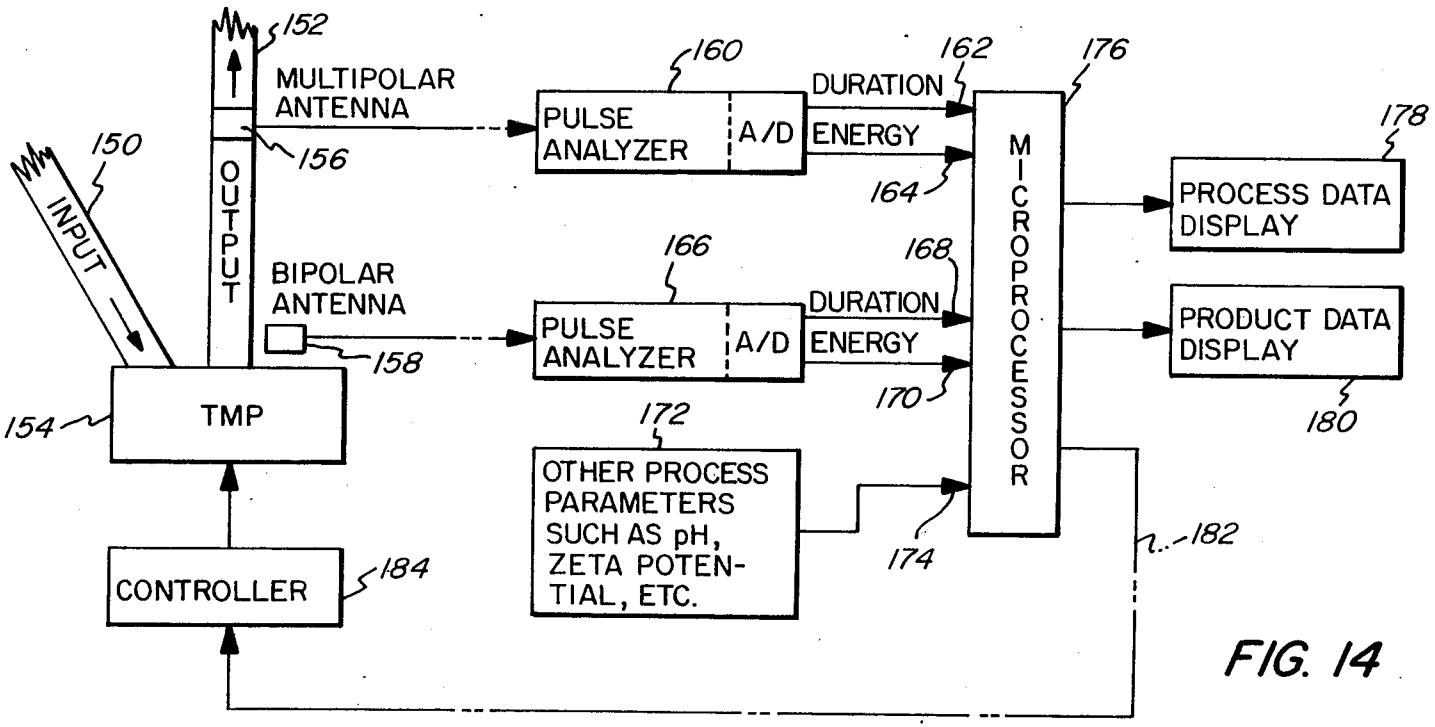
FIG. 14 is a block diagram of apparatus for controlling a thermal mechanical pulping machine in response to detected electron transfer phenomena in accordance with the present invention.
Figure 15:
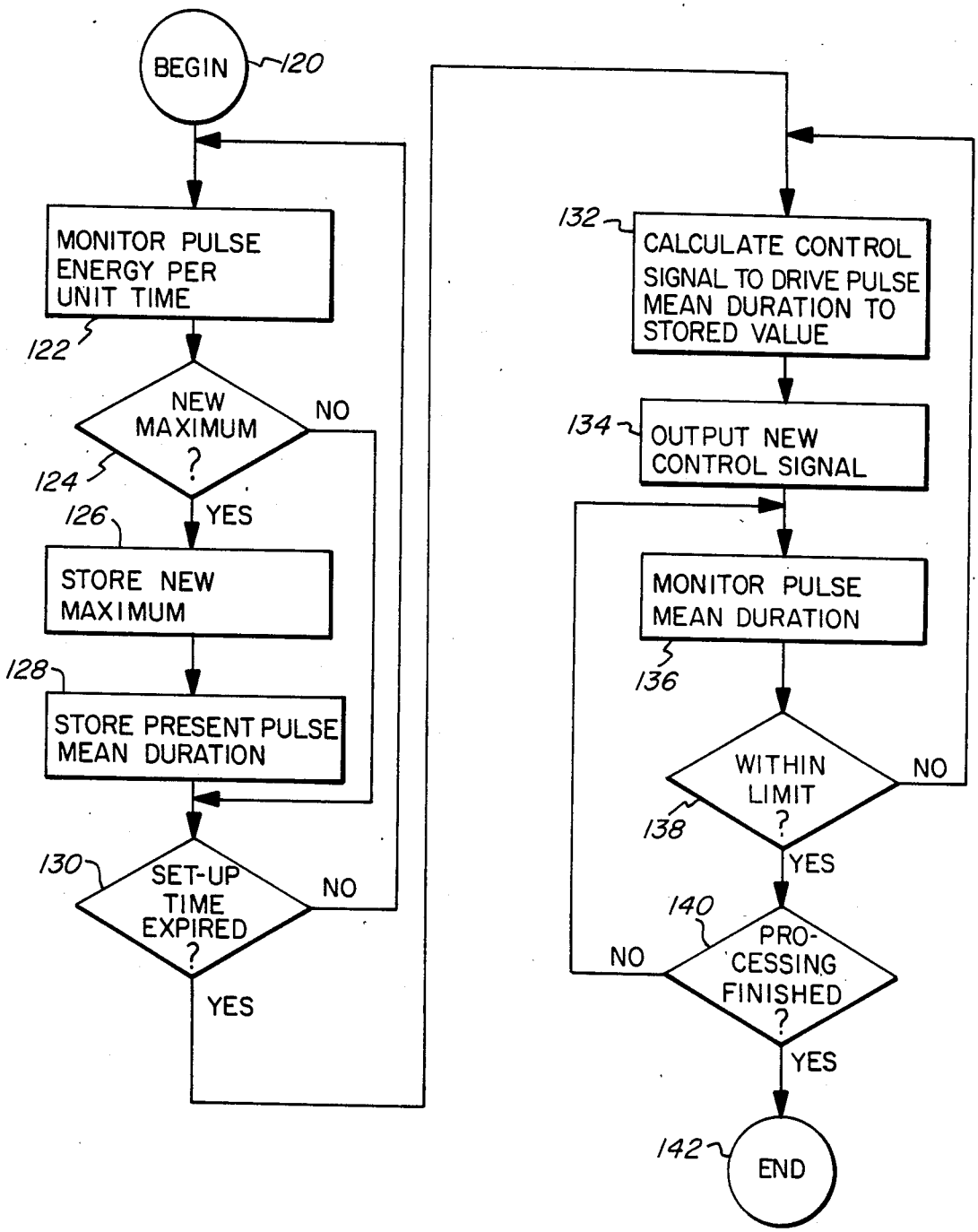
FIG. 15 is a flow chart illustrating an algorithm of the type which may be used in the apparatus of FIG. 14 to control the refining process.

FIG. 14 is a block diagram of a refiner process control system in accordance with the present invention. A thermal mechanical pulping machine 154 has wood chips or a slurry input thereto via input conduit 150. The output of the pulping machine travels through output conduit 152. A multipolar antenna 156 is provided downstream of the pulping machine in output conduit 152 to detect randomly polarized radiation emanating from the slurry and indicative of recombination phenomena. A bi-polar antenna 158 is mounted adjacent the pulp machine 154 to detect the polarized radiation indicative of dissociation phenomena.

The output of multi-polar antenna 156 is input to a pulse analyzer circuit 160 which can, for example, incorporate the circuit shown in FIG. 11. Pulse analyzer 160 includes an analog-to-digital converter (A/D) and produces a digital pulse mean duration output signal on line 162 and a digital pulse energy per unit time signal on output line 164. The digital duration and energy signals are input for processing to a microprocessor 176.

The output of bi-polar antenna 158 is input to a pulse analyzer 166 which can be identical to pulse analyzer 160. Pulse analyzer 166 produces a digital pulse mean duration signal on output line 168 and a digital pulse energy per unit time signal on line 170. Both of these signals are input to microprocessor 176 for processing. Other process parameters, as indicated at box 172, can also be input via line 174 to microprocessor 176 in a conventional manner.

Microprocessor 176 uses the signals input thereto to drive a process data display 178 and a product data display 180. The process data displayed on display 178 is data indicative of the ongoing refining process, e.g., horsepower, flow rate, etc. The product data displayed on display 180 can include, for example, a prediction of mean fiber size and a prediction of Zeta potential. The present invention enables Zeta potential to be predicted by merely subtracting the magnitude of the energy signal on line 164 from pulse analyzer 160 from the magnitude of the energy signal on line 170 from pulse analyzer 166.

Microprocessor 176 also outputs a process control signal on line 182 that is input to a process controller 184 for controlling the operation of the thermal mechanical pulping machine 154. Controller 184 can vary parameters in the pulping machine such as the refiner disk gap, rotation speed of the refining disks, feed rate and the like.

An example of the several possible algorithms that can be used by microprocessor 176 to optimize the refining process is illustrated in the flow chart of FIG. 15. The routine starts at box 120, and at box 122 the pulse energy per unit time of pulses detected by one or both of multi-polar antenna 156 and bi-polar antenna 158 is monitored. At box 124, a determination is made as to whether the pulse energy currently being monitored represents a maximum pulse energy per unit time. If so, control passes to box 126 and the new maximum is stored in memory. Then, at box 128, the present value of the pulse mean duration is stored in memory. Thus, the currently stored pulse mean duration value will be that which corresponds with the maximum pulse energy monitored up until the present time.

Control then passes to box 130 (which also receives control directly from box 124 if a new maximum has not been detected), and a determination is made as to whether the initial set-up time (e.g., a 5 or 10 minute period) for determining the maximum pulse energy per unit time of the ongoing process has expired. If not, control passes to box 122 and the process repeats for the pre-determined initial set-up time so that the maximum pulse energy during set-up is determined. After the set-up time has expired, box 130 passes control to box 132 where a process control signal is calculated. The value of the process control signal will be that necessary to drive controller 184, and thereby the pulping machine 154, to maintain the pulse mean duration of detected radiation at the value stored by box 128. As already noted, this stored value will represent the maximum pulse energy per unit time produced by the refining process, and corresponds to the maximum efficiency of the refiner.

From box 132, control passes to box 134 where the new process control signal just calculated is output to controller 184. Then, at box 136, the pulse mean duration is monitored by microprocessor 176 and at box 138, a determination is made as to whether the monitored pulse mean duration is within a predetermined limit defining a range above and below the value stored at box 128. If not, control passes back to box 132 where a new process control signal is calculated to maintain the pulse mean duration at the desired value.

When the monitored pulse mean duration is within the predetermined limit value, control passes from box 138 to box 140 which determines if the refiner process has been completed. If not, control passes back to box 136. If the refining process is finished, control passes to box 142 where the routine ends.

It will now be appreciated that the present invention provides an apparatus and method for controlling a particle refining process in response to detected electron transfer phenomena. Various quantities can be determined or predicted on the basis of polarized and randomly polarized radiation produced by and detected from a refining process. For example, efficiency of the refining process, particle size, Zeta potential, and floculation can all be predicted and/or controlled. The detected radiation is indicative of dissociation and recombination phenomena in the slurry being refined. Data derived from such radiation can be used to produce a process control signal for optimizing the operation of the refiner on a real-time basis.

I claim:

1. Appartus for controlling a particle refining process of a refiner in response to detected electron transfer phenomena comprising:

first antenna means for detecting polarized radiation naturally emanating from the frame of said refine due to electron/particle dissociation in a slurry being refined;

second antenna means for detecting randomly polarized radiation naturally emanating from said slurry downstream from said refiner due to electron/particle recombination;

first signal producing means coupled to said first antenna means for producing a first signal indicative of pulse energy per unit time and a second signal indicative of pulse mean duration of polarized radiation pulses detected by said first antenna means;

second signal producing means coupled to said second antenna means for producing a third signal indicative of pulse energy per unit time and a fourth signal indicative of pulse mean duration of randomly polarized radiation pulses detected by said second antenna means;

process control signal means for producing a process control signal derived from the first, second third, and fourth signals corresponding to the value of the pulse mean duration of radiation pulses at the occurrence of the maximum pulse energy per unit time; and control means responsive to said process control signal for controlling pulping parameters of the particle refining process of said refiner.

2. The apparatus of claim 1 wherein the polarized radiation detected by said first antenna means is radiated in a plane normal to the refiner frame.

3. The apparatus of claim 1 wherein said first antenna means comprises a bipolar antenna mounted adjacent the refiner frame.

4. The apparatus of claim 3 wherein said second antenna means comprises a symetrical multipolar antenna mounted adjacent said slurry and having a uniform response to electromagnetic radiation polarized in any plane.

5. The apparatus of claim 1 wherein said second antenna means comprises a symmetrical multipolar antenna mounted adjacent said slurry and having a uniform response to electromagnetic radiation polarized in any plane.

6. A thermal mechanical pulping machine system comprising:

a metallic frame supporting a pair of spaced refinger disks defining a refiner gap, at least one of said disks being mounted for rotation relative to the the other;

gap adjusting means for adjusting the size of the refiner gap in response to a control signal;

input conduit means for feeding material to be refined into said refiner gap;

output conduit means for transporting refined material from said refiner gap to subsequent processing apparatus;

first antenna means for detecting polarized electromagnetic radiation naturally emanating from said metallic frame adjacent the refiner gap in a plane normal to said metallic frame;

second antenna means for detecting randomly polarized electromagnetic radiation naturally emanating from refined material in said output conduit means;

first signal producing means coupled to said first antenna means for producing a first signal indicative of pulse energy per unit time and a second signal indicative of pulse means duration of polarized radiation pulses detected by said first antenna means;

second signal producing means coupled to said second antenna means for producing a third signal indicative of pulse energy per unit time and a fourth signal indicative of pulse means duration of randomly polarized radiation pulses detected by said second antenna means;

process control signal producing means for producing a process control signal derived from the first, second, third, and fourth signals; and gap control means for coupling said process control signal to said gap adjusting means to control the refiner gap size.

7. The apparatus of claim 6 wherein said process control signal producing means comprises:

monitoring means for monitoring said first and third signals over a period of time to determine the maximum pulse energy per unit time detected by said first and second antenna means;

measuring means for measuring the magnitude of said second and fourth signals upon the occurrence of the maximum pulse energy per unit time determined by said monitoring means to determine the value of the pulse mean duration of detected radiation at said occurrence; and adjusting means for adjusting said process control signal to subsequently maintain said second and fourth signals at said valve of the pulse mean duration measured by said measuring means.

8. The apparatus of claim 6 wherein said first antenna means comprises a bipolar antenna.

9. The apparatus of claim 8 wherein said second antenna means comprises a symmetrical multipolar antenna having a uniform response to electromagnetic radiation polarized in any plane.

10. The apparatus of claim 6 wherein said second antenna means comprises a symmetrical multipolar antenna having a uniform response to electromagnetic radiation polarized in any plane.

11. Apparatus for controlling a particle refining process of a refiner in response to detected electron transfer phenomena comprising:

detecting means for detecting polarized electromagnetic radiation naturally emanating from said refiner due to electron/particle dissociating in a material being defined;

first signal producing means coupled to said detecting means for producing a first signal indicative of pulse energy per unit time of radiation pulses detected by said detecting means;

second signal producing means coupled to said detecting means for producing a second signal indicative of pulse mean duration of radiation pulses detected by said detecting means;

process control signal producing means for producing a process control signal derived from said first and second signals corresponding to the value of the pulse mean duration of radiation pulses at the occurrence of the maximum pulse energy per unit time; and control means responsive to said process control signal for controlling a parameter of the particle refining process of said refiner.

12. The apparatus of claim 11 wherein the detected polarized electromagnetic radiation is radiated in a plane normal to the refine frame of said refiner.

13. The apparatus of claim 11 wherein said detecting means comprises a bipolar antenna mounted adjacent the refiner frame of said refiner.

14. Apparatus for controlling a particle refining process of a refiner in response to detected electron transfer phenomena comprising:

detecting means for detecting randomly polarized electromagnetic radiation naturally emanating from material output from said refiner due to electron/particle recombination in the material being refined;

first signal producing means coupled to said detecting means for producing a first signal indicative of pulse energy per unit time of raddiation pulses detected by said detecting means;

second signal producing means coupled to said detecting means for producing a second signal indicative of pulse means duration of radiation pulses detected by said detecting means;

process control signal producing means for producing a process control signal derived from said first and second signals corresponding to the value of the pulse mean duration of radiation pulses at the occurrence of the maximum pulse energy per unit time; and control means responsive to said process control signal for controlling a parameter of the particle refining process of said refiner.

15. The apparatus of claim 14 wherein said detecting means comprises a symmetrical multipolar antenna having a uniform response to electromagnetic radiation polarized in any plane.

16. A method for controlling a particle refining process in response to detected electron transfer phenomena comprising the steps of:

detecting polarized polarized electromagnetic radiation naturally emanating from the frame of a refiner due to electron/particle dissociation in a slurry being refined;

producing a first signal indicative of the pulse energy per unit time of detected pulses of said radiation;

producing a second signal indicative of the pulse mean duration of detected pulses of said radiation;

producing a process control signal from said first and second signals; and controlling a parameter of the particle refining process of said refiner with said process control signal.

17. The method of claim 16 comprising the further steps of:

detecting randomly polarized electromagnetic radiation naturally emanating from the slurry downstream from said refiner due to electron/particle recombination;

producing a third signal indicative of the pulses energy per unit time of detected pulses of said randomly polarized radiation;

producing a fourth signal indicative of the pulse means duration of detected pulses of said randomly polarized radiation; and using said third and fourth signals together with said first and second signals to produce said process control signal.

18. A method for controlling a particle refining process of a refiner in response to detected electron transfer phenomena comprising the steps of:

detecting randomly polarized electromagnetic radiation naturally emanating from a slurry being refined due to electron/particle recombination;

producing a first signal indicative of the pulse energy per unit time of detected pulses of said radiation;

producing a second signal indicative of the pulse means duration of detect pulses of said radiation;

producing a process control signal from said first and second signals corresponding to the value of the pulse mean duration of radiation pulses at the occurrence of the maximum pulse energy per unit time; and controlling a parameter of the particle refining process of said refiner with said process control signal.

19. A method for controlling a particle refining process in response to detected electron transfer phenomena comprising the steps of:

receiving pulses of electromagnetic radiation naturally emanating froma refiner during a refining process;

processing said pulses to obtain data indicative of the receipt of a pulse of maximum pulse energy per unit time to optimize performance ofthe refining process;

producing a process control signal in response to said data; and controlling a parameter of the particle refining process of said refiner with said process control signal to optimize the refining process.

20. Apparatus for controlling a particle refining process of a refiner in response to detected electron transfer phenomena comprising:

receiving means for receiving pulses of electromagnetic radiation naturally emanating from said refiner during a refining process;

pulse processing means coupled to said receiving means for processing said pulses to obtain data indicative of the optimum performance of the refining process;

control signal producing means coupled to said pulse processing means for producing a control signal in response to said data; and control means responsive to said process control signal for controlling a parameter of the particle refining process of said refiner to optimize its performance.

21. The apparatus of claim 20 wherein said refiner is a thermal mechanical pulping machine.

* * * * *